US010428527B1

(12) United States Patent
Freeman, Jr.

(10) Patent No.: US 10,428,527 B1
(45) Date of Patent: Oct. 1, 2019

(54) ROOF VALLEY BATTEN

(71) Applicant: Ricky G. Freeman, Jr., Ceres, CA (US)

(72) Inventor: Ricky G. Freeman, Jr., Ceres, CA (US)

( * ) Notice: Subject to any disclaimer, the term of this patent is extended or adjusted under 35 U.S.C. 154(b) by 0 days.

(21) Appl. No.: 16/005,878

(22) Filed: Jun. 12, 2018

(51) Int. Cl.

| | |
|---|---|
| ***B66C 23/06*** | (2006.01) |
| ***E04D 13/04*** | (2006.01) |
| ***E04D 13/064*** | (2006.01) |
| ***E04D 1/36*** | (2006.01) |
| *E04D 1/30* | (2006.01) |

(52) U.S. Cl.
CPC ..... *E04D 13/0445* (2013.01); *E04D 1/36* (2013.01); *E04D 13/064* (2013.01); *E04D 2001/304* (2013.01); *E04D 2013/0454* (2013.01)

(58) Field of Classification Search
CPC ..... E04D 13/0445; E04D 1/36; E04D 13/064; E04D 2013/0454; E04D 2001/304
USPC ..... 52/13
See application file for complete search history.

(56) References Cited

U.S. PATENT DOCUMENTS 678,995 A * 7/1901 Carnes ..... E04D 13/064 52/13
1,163,034 A * 12/1915 Phippen ..... E04D 12/004 52/302.1
3,236,170 A * 2/1966 Meyer ..... E04D 13/174 454/365
3,264,790 A * 8/1966 Beals ..... E04D 3/40 52/14
3,352,649 A * 11/1967 Tennison, Jr. ..... B21D 5/08 29/897.3
3,647,606 A * 3/1972 Notaro ..... B29C 70/24 428/184
3,743,568 A * 7/1973 De Wolf ..... B65D 65/403 428/178
4,449,333 A * 5/1984 Stratton ..... E04D 3/40 52/13
4,996,812 A * 3/1991 Venable ..... E04D 5/12 428/148
5,115,603 A * 5/1992 Blair ..... E04D 13/0445 52/11
5,304,095 A * 4/1994 Morris ..... F24F 7/02 454/365
5,369,926 A * 12/1994 Borland ..... E04D 11/02 428/158
5,471,807 A 12/1995 Vasquez
(Continued)

FOREIGN PATENT DOCUMENTS

WO 0166871 A 9/2001

*Primary Examiner* — Basil S Katcheves

(57) ABSTRACT

The roof valley batten is configured for use with a roof. The roof valley batten attaches a plurality of shingles to a structure formed by a roof valley and a metal valley. The roof valley batten attaches to the metal valley in a manner that does not require the use of a fastening device that perforates a structure selected from the group consisting of the roof valley and the metal valley. The roof valley batten provides a mounting structure for the plurality of shingles that allows the use of a fastening device that does require the perforation of the roof valley batten. The roof valley batten comprises a mounting surface, a plurality of pedestals and a plurality of channels. The plurality of pedestals attach to the mounting surface. The plurality of channels are drainage channels formed within the plurality of pedestals.

13 Claims, 2 Drawing Sheets

(56) References Cited

U.S. PATENT DOCUMENTS

| | | | | | |
|---|---|---|---|---|---|
| 5,540,022 | A * | 7/1996 | Morris | B05C 11/023 | 52/309.8 |
| 5,673,521 | A * | 10/1997 | Coulton | E04D 13/176 | 126/671 |
| 6,079,166 | A * | 6/2000 | Mason | E04D 13/174 | 454/365 |
| D465,839 | S * | 11/2002 | Sells | D23/373 | |
| 6,718,719 | B1 * | 4/2004 | Hagerty | E04D 12/004 | 52/302.3 |
| 6,981,916 | B2 * | 1/2006 | Coulton | E04D 13/176 | 454/365 |
| 7,735,275 | B2 | 6/2010 | Vandewater, Jr. | | |
| 7,805,889 | B2 | 10/2010 | Barnett | | |
| 8,033,073 | B1 * | 10/2011 | Binder | E04D 12/004 | 52/302.3 |
| 8,327,605 | B1 * | 12/2012 | Binder | E04D 12/004 | 52/302.3 |
| 8,635,823 | B2 * | 1/2014 | McCary | E04C 2/34 | 52/169.14 |
| 8,650,804 | B2 | 2/2014 | Skoretz | | |
| 9,151,059 | B2 * | 10/2015 | Pavlansky | E04D 13/174 | |
| D765,822 | S | 9/2016 | Stewart | | |
| 2003/0159365 | A1 | 8/2003 | Hutton | | |
| 2003/0172606 | A1 | 9/2003 | Anderson | | |
| 2004/0255522 | A1 | 12/2004 | Knudson | | |
| 2005/0126088 | A1 * | 6/2005 | Rotter | E04D 1/36 | 52/198 |
| 2008/0220714 | A1 * | 9/2008 | Caruso | E04D 13/152 | 454/365 |
| 2009/0107073 | A1 * | 4/2009 | Kalkanoglu | B32B 15/08 | 52/411 |

* cited by examiner

ROOF VALLEY BATTEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of building including roofs, more specifically, a batten configured for use in a roof valley.

SUMMARY OF INVENTION

The roof valley batten is configured for use with a roof. The roof is further defined with a roof valley, a metal valley and a plurality of shingles. The metal valley is a flashing that installs in the roof valley. The plurality of shingles forms the superior water-repellent surface of the roof. The roof valley batten is a structure that attaches the plurality of shingles to the structure formed by the roof valley and the metal valley. The roof valley batten attaches to the metal valley in a manner that does not require the use of a fastening device that perforates a structure selected from the group consisting of the roof valley and the metal valley. The roof valley batten provides a mounting structure to the plurality of shingles that allow the plurality of shingles to be fastened to the roof valley batten using a fastening device that does require the perforation of the roof valley batten. The roof valley batten comprises a mounting surface, a plurality of pedestals and a plurality of channels. The plurality of pedestals attach to the mounting surface. The plurality of channels are drainage channels formed within the plurality of pedestals.

These together with additional objects, features and advantages of the roof valley batten will be readily apparent to those of ordinary skill in the art upon reading the following detailed description of the presently preferred, but nonetheless illustrative, embodiments when taken in conjunction with the accompanying drawings.

In this respect, before explaining the current embodiments of the roof valley batten in detail, it is to be understood that the roof valley batten is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the roof valley batten.

It is therefore important that the claims be regarded as including such equivalent construction insofar as they do not depart from the spirit and scope of the roof valley batten. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
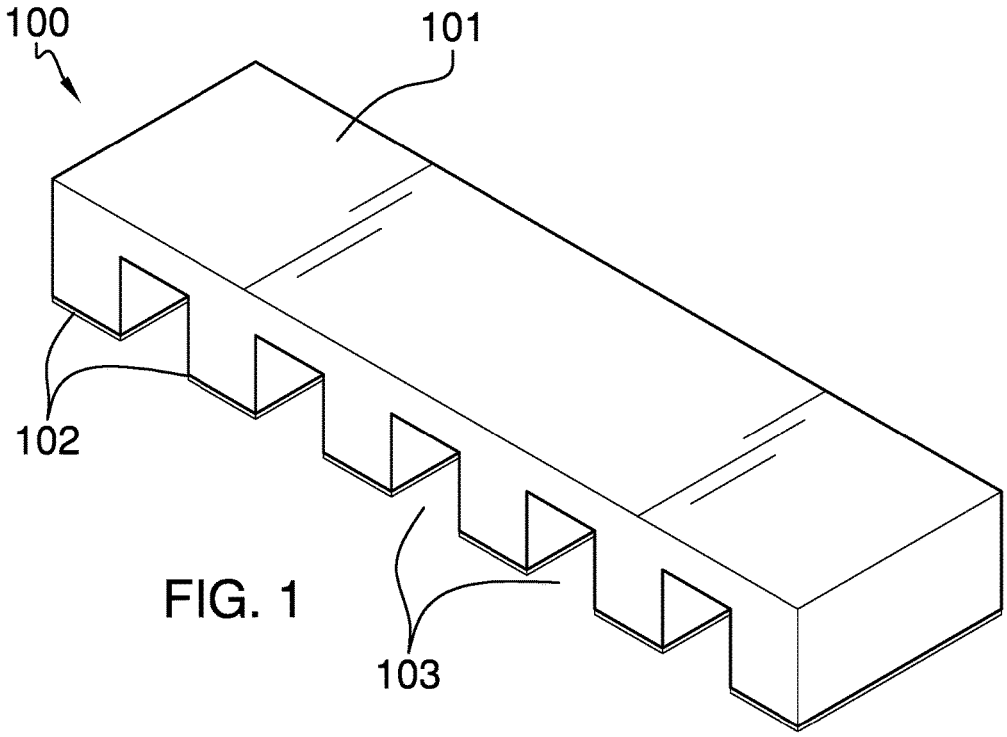
FIG. 1 is a perspective view of an embodiment of the disclosure.
Figure 2:
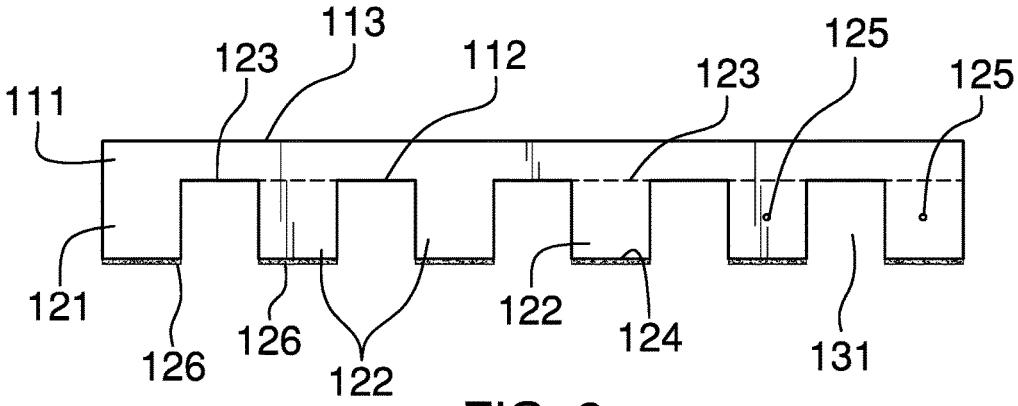
FIG. 2 is a front view of an embodiment of the disclosure.
Figure 3:
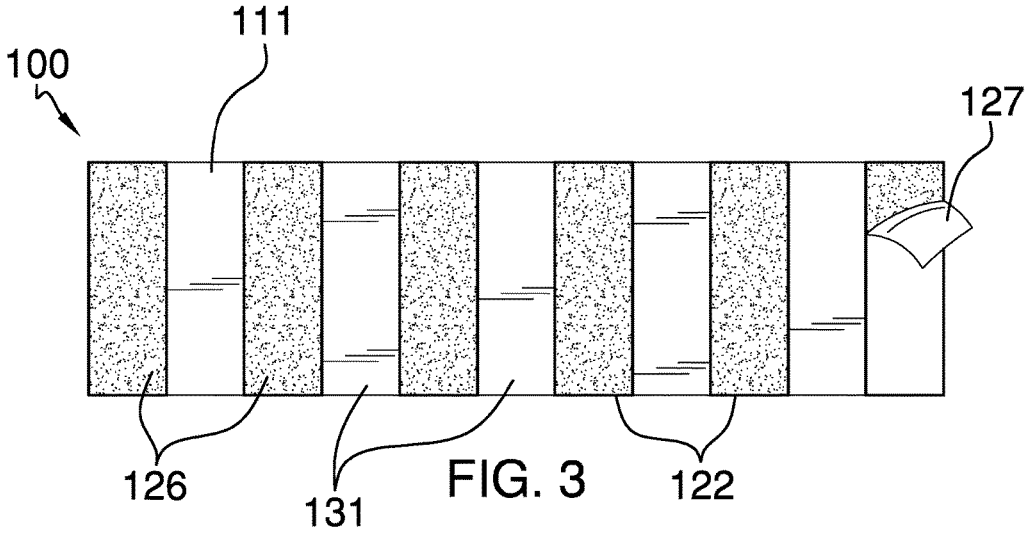
FIG. 3 is a bottom view of an embodiment of the disclosure.
Figure 4:
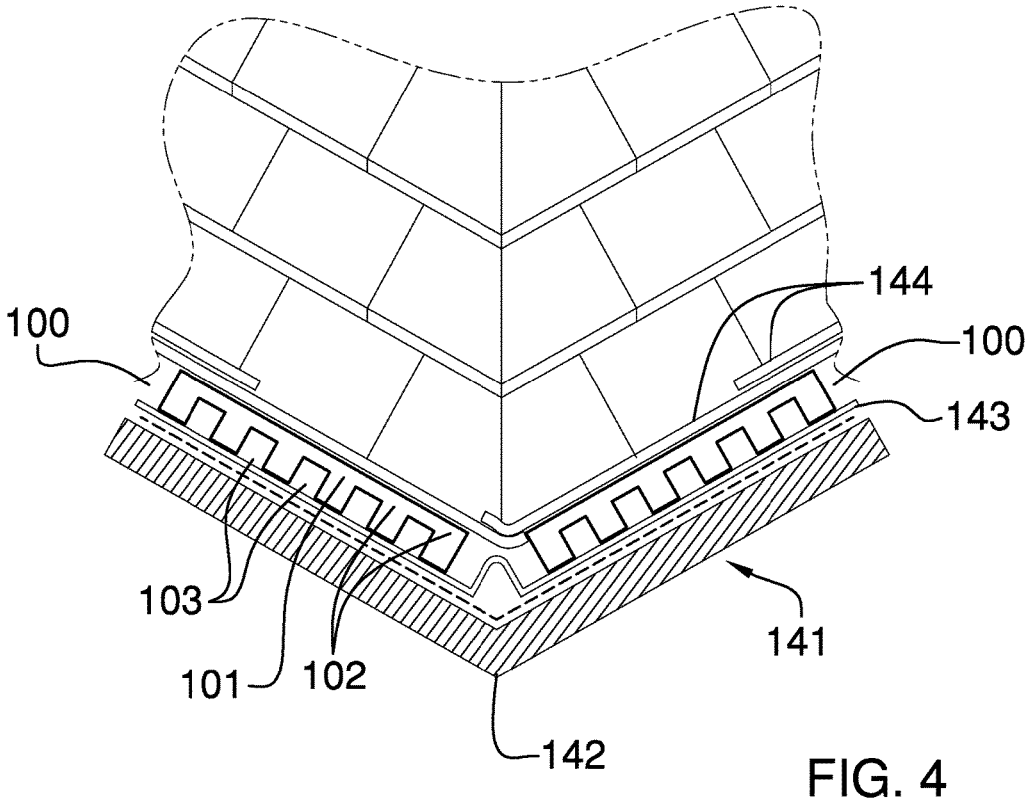
FIG. 4 is an in-use view of an embodiment of the disclosure.

Detailed reference will now be made to one or more potential embodiments of the disclosure, which are illustrated in FIGS. 1 through 4.

The roof valley batten 100 (hereinafter invention) is configured for use with a roof 141. The roof 141 is further defined with a roof 141 valley 142, a metal valley 143 and a plurality of shingles 144. The metal valley 143 is a flashing that installs in the roof 141 valley 142. The plurality of shingles 144 forms the superior water-repellent surface of the roof 141. The invention 100 is a structure that attaches the plurality of shingles 144 to the structure formed by the roof 141 valley 142 and the metal valley 143.

In the first potential embodiment of the disclosure, the roof 141 is assumed to be a pitched roof 141. The roof 141 is defined in greater detail elsewhere in this disclosure. The roof 141 valley 142 is defined in greater detail elsewhere in this disclosure. The metal valley 143 is defined in greater detail elsewhere in this disclosure. The plurality of shingles 144 is defined in greater detail elsewhere in this disclosure.

The invention 100 attaches to the metal valley 143 in a manner that does not require the use of a fastening device that perforates a structure selected from the group consisting of the roof 141 valley 142 and the metal valley 143. The invention 100 provides a mounting structure to the plurality of shingles 144 that allow the plurality of shingles 144 to be fastened to the invention 100 using a fastening device that does require the perforation of the invention 100. The invention 100 comprises a mounting surface 101, a plurality of pedestals 102 and a plurality of channels 103. The plurality of pedestals 102 attach to the mounting surface 101. The plurality of channels 103 are drainage channels formed within the plurality of pedestals 102.

The mounting surface 101 is the superior structure of the invention 100. The plurality of shingles 144 attach to the mounting surface 101. The design of the mounting surface 101 is such that each of the plurality of shingles 144 can be nailed into the mounting surface 101 without causing perforation damage to a structure selected from the group consisting of the roof 141 valley 142 and the metal valley 143. The mounting surface 101 comprises a first rectangular block structure 111. The first rectangular block structure 111 is further defined with an inferior face 112 and a superior face 113.

The first rectangular block structure 111 is a solid rectangular block structure. The first rectangular block structure 111 is configured to receive nails that are used to secure the plurality of shingles 144 to the first rectangular block structure 111. The inferior face 112 is the face of the first rectangular block structure 111 that is proximal to the metal valley 143 after proper installation of the invention 100. The superior face 113 is the face of the first rectangular block structure 111 that is distal from the inferior face 112. The plurality of shingles 144 attach to the superior face 113 of the first rectangular block structure 111.

The plurality of pedestals 102 forms a pedestal structure that raises the mounting surface 101 above the metal valley 143. The plurality of pedestals 102 transfers the load path of the mounting surface 101 and the plurality of shingles 144 to the roof 141 through the metal valley 143 and the roof 141 valley 142. Each of the plurality of pedestals 102 attaches to the inferior face 112 of the mounting surface 101. Each of the plurality of pedestals 102 projects perpendicularly away from the mounting surface 101. Each individual pedestal 121 is identical. Each of the plurality of pedestals 102 are equidistantly spaced. The plurality of pedestals 102 comprises a collection of individual pedestals 121. Each individual pedestal 121 comprises a second rectangular block structure 122, an adhesive coating 126, and a parchment cover 127. The second rectangular block structure 122 is further defined with a fixed face 123, a free face 124, and a center axis 125.

The fixed face 123 is the face of the second rectangular block structure 122 that attaches to the inferior face 112 of the first rectangular block structure 111. The free face 124 is the face of the second rectangular block structure 122 that is distal from the fixed face 123. The center axis 125 of each second rectangular block structure 122 is parallel to the interior face 112 of the first rectangular block structure 111.

Each second rectangular block structure 122 is a solid rectangular block structure. The second rectangular block structure 122 attaches to the first rectangular block structure 111 in the manner of a cantilever. Each second rectangular block structure 122 raises the mounting surface 101 above the metal valley 143 of the roof 141. Each second rectangular block structure 122 carries a portion of the load path of the mounting surface 101 and the plurality of shingles 144 to the metal valley 143 of the roof 141. Each second rectangular block structure 122 projects perpendicularly away from the first rectangular block structure 111.

Each second rectangular block structure 122 is equidistantly spaced. By equidistant spacing is meant that the span of the distance between the center axis 125 of any first individual pedestal 121 selected from the plurality of pedestals 102 and the center axis 125 of any second adjacent individual pedestal 121 selected from the individual pedestal 121 is identical.

The adhesive coating 126 is an adhesive material. The adhesive coating 126 is applied as a coating to the free face 124 of each second rectangular block structure 122. The adhesive coating 126 attaches each second rectangular block structure 122 to the metal valley 143 of the roof 141. In the first potential embodiment of the disclosure, the adhesive coating 126 is a bitumen-based material. The parchment cover 127 is a sheet of parchment paper. The shape of the parchment cover 127 is geometrically identical to the shape of the free face 124 of the second rectangular block structure 122. The parchment cover 127 protects the adhesive coating 126 from debris and oxidation during storage of the invention 100. The parchment cover 127 is a disposable item that is removed before installation of the invention 100.

The plurality of channels 103 forms a drainage structure that allows water to pass through the invention 100 as the water drainage follows the pitch of the roof 141. Each of the plurality of channels 103 is a negative space. Each of the plurality of channels 103 forms a channel that transports the water drainage along the direction of the pitch. The plurality of channels 103 comprises a collection of individual channels 131. Each individual channel 131 comprises a third rectangular block structure 132.

Each third rectangular block structure 132 is a negative space formed between any first individual pedestal 121 selected from the plurality of pedestals 102 and any second adjacent individual pedestal 121 selected from the plurality of pedestals 102. Each individual channel 131 forms an enclosed channel that transports water drainage through the invention 100 along the pitch of the roof 141.

The following definitions were used in this disclosure:

Batten: As used in this disclosure, a batten is a rectangular block structure used to reinforce a larger structure, especially a joint between two objects.

Bitumen: As used in this disclosure, bitumen refers to a viscous mixture of primarily organic compounds that is most commonly derived from the residue created by the distillation of petroleum.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Channel: As used in this disclosure, a channel is a tubular passage through which an object or fluid is passed through.

Flashing: As used within this disclosure, a flashing is a sheeting that forms a water barrier between a roof and a second structure.

Correspond: As used in this disclosure, the term correspond is used as a comparison between two or more objects wherein one or more properties shared by the two or more objects match, agree, or align within acceptable manufacturing tolerances.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. Always use Correspond and One to One Inferior: As used in this disclosure, the term inferior refers to a directional reference that is parallel to and in the same direction as the force of gravity when an object is positioned or used normally.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

Parchment: As used in this disclosure, parchment refers to a silicone impregnated sheet of paper. Parchment is known for having high-temperature resistance and for resisting saturation by a liquid.

Pedestal: As used in this disclosure, a pedestal is an intermediary load bearing structure that that transfers a load path between a supporting surface and an object, structure, or load.

Pitch: As used in this disclosure, a pitch refers to a cant formed between a line or a plane and the horizon.

Pitched Roof: As used in this disclosure; a pitched roof refers to a roof wherein the surface of the roof forms an angle relative to the horizon.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Rectangular Block: As used in this disclosure, a rectangular block refers to a three-dimensional structure comprising six rectangular surfaces formed at right angles. Within this disclosure, a rectangular block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Shingle: As used in this disclosure, a shingle is a tile that is used to form the superior surface of a roof. Shingle are overlapped such that water is routed along the pitch without leaking beneath the layer of shingles.

Silicone: As used in this disclosure, silicone is a substance formed from silicon (Si) and oxygen (O) that forms the backbone of polymer type chains similar to polymers that are formed by carbon. Though exceptions do exist, silicone is generally considered to be less reactive and to have better heat resistance when compared to most common carbon-based polymers.

Superior: As used in this disclosure, the term superior refers to a directional reference that is parallel to and in the opposite direction of the force of gravity.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline, they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Valley: As used in this disclosure, a valley refers to: a) the intersection of two sloped roofs; or, b) a metal structure that forms the flashing underneath a valley as described in (a).

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A roof valley batten comprising:

a mounting surface, a plurality of pedestals and a plurality of channels;

wherein the plurality of pedestals attach to the mounting surface;

wherein the plurality of channels are formed within the plurality of pedestals;

wherein the roof valley batten is used with a roof;

wherein the roof is further defined with a roof valley, a metal valley and a plurality of shingles;

wherein the roof valley and the metal valley form a structure;

wherein the roof valley batten attaches the plurality of shingles to the structure formed by the roof valley and the metal valley;

wherein the plurality of shingles attach to the mounting surface;

wherein the mounting surface comprises a first rectangular block structure;

wherein the first rectangular block structure is further defined with an inferior face and a superior face;

wherein the first rectangular block structure is a solid rectangular block structure;

wherein the plurality of shingles attach to the superior face of the first rectangular block structure;

wherein the plurality of pedestals forms a pedestal structure that raises the mounting surface above the metal valley;

wherein the plurality of pedestals transfers the load path of the mounting surface and the plurality of shingles to the roof through the metal valley and the roof valley;

wherein each of the plurality of pedestals attaches to the inferior face of the mounting surface;

wherein each of the plurality of pedestals projects perpendicularly away from the mounting surface;

wherein the plurality of pedestals comprises a collection of individual pedestals;

wherein each individual pedestal comprises a second rectangular block structure, an adhesive coating, and a parchment cover;

wherein the adhesive coating attaches the parchment cover to the second rectangular block structure;

wherein the second rectangular block structure is further defined with a fixed face, a free face, and a center axis.

2. The roof valley batten according to claim 1 wherein the roof valley batten attaches to the metal valley with a first fastening device;

wherein the first fastening device does not perforate a structure selected from the group consisting of the roof valley and the metal valley.

3. The roof valley batten according to claim 2 wherein a second fastening device attaches the plurality of shingles to the mounting surface;

wherein the second fastening device is selected from the group consisting of a fastening device that requires the perforation of the mounting surface and a fastening device that does not require the perforation of the mounting surface.

4. The roof valley batten according to claim 3 wherein the mounting surface protects the structure selected from the group consisting of the roof valley and the metal valley from perforation damage.

5. The roof valley batten according to claim 4 wherein the superior face of the first rectangular block structure receives the second fastening device.

6. The roof valley batten according to claim 5 wherein the center axis of each second rectangular block structure is parallel to the inferior face of the first rectangular block structure.

7. The roof valley batten according to claim 6 wherein each second rectangular block structure is a solid rectangular block structure;

wherein the second rectangular block structure attaches to the first rectangular block structure in the manner of a cantilever;

wherein the fixed face attaches to the inferior face of the first rectangular block structure;

wherein each second rectangular block structure is positioned between the mounting surface and the metal valley of the roof;

wherein each second rectangular block structure carries a portion of the load path of the mounting surface and the plurality of shingles to the metal valley of the roof.

8. The roof valley batten according to claim 7 wherein each second rectangular block structure projects perpendicularly away from the first rectangular block structure.

9. The roof valley batten according to claim 8 wherein each second rectangular block structure is equidistantly spaced;

wherein by equidistant spacing is meant that the span of the distance between the center axis of any first individual pedestal selected from the plurality of pedestals and the center axis of any second adjacent individual pedestal selected from the individual pedestal is identical.

10. The roof valley batten according to claim 9 wherein the plurality of channels comprises a collection of individual channels;

wherein each individual channel comprises a third rectangular block structure;

wherein each individual channel forms an enclosed channel that transports water drainage through the roof valley batten along the pitch of the roof.

11. The roof valley batten according to claim 10 wherein the adhesive coating is an adhesive material;

wherein the adhesive coating is applied as a coating to the free face of each second rectangular block structure;

wherein the adhesive coating attaches each second rectangular block structure to the metal valley of the roof.

12. The roof valley batten according to claim 11 wherein the parchment cover is a sheet of parchment paper;

wherein the parchment cover protects the adhesive coating.

13. The roof valley batten according to claim 12 wherein the adhesive coating is a bitumen-based material.

* * * * *